United States Patent [19]

Prevedel et al.

[11] Patent Number: 4,813,387

[45] Date of Patent: Mar. 21, 1989

[54] INTERNAL COMBUSTION, RECIPROCATING PISTON ENGINE

[75] Inventors: Kurt Prevedel; Peter Wünsche; Hans Oberth, all of Graz, Austria

[73] Assignee: Avl Gesellschaft fur Verbrennungskraftmaschinen und Messtechnik M.B., Graz, Austria

[21] Appl. No.: 224,150

[22] Filed: Jul. 26, 1988

[30] Foreign Application Priority Data

Aug. 5, 1987 [AT] Austria ..... 1986/87

[51] Int. Cl.[4] ..... F02B 33/12

[52] U.S. Cl. ..... 123/73 B; 123/73 D; 123/74 D

[58] Field of Search ..... 123/65 B, 68, 71, 73 R, 123/73 AF, 73 D, 73 DA, 74 D, 317, 318, 80 D, 73 A

[56] References Cited

U.S. PATENT DOCUMENTS

| | | | |
|---|---|---|---|
| 1,977,657 | 10/1934 | Watson | 123/74 D |
| 2,445,715 | 7/1948 | Jennings | 123/73 D |
| 2,564,913 | 8/1951 | Mead | 123/74 D |
| 3,003,486 | 10/1961 | Werner | 123/74 D |
| 3,973,532 | 8/1976 | Litz | 123/317 |

FOREIGN PATENT DOCUMENTS

| | | | |
|---|---|---|---|
| 710288 | 5/1943 | Fed. Rep. of Germany . | |
| 954654 | 12/1956 | Fed. Rep. of Germany | 123/73 D |
| 3637811 | 5/1987 | Fed. Rep. of Germany . | |
| 1061504 | 4/1954 | France | 123/73 D |

*Primary Examiner*—David A. Okonsky

*Attorney, Agent, or Firm*—Watson, Cole, Grindle & Watson

[57] ABSTRACT

The present invention relates to an internal combustion, reciprocating piston engine with a piston which, on its up-stroke, sucks air or a fuel-air mixture via a flap valve or a similar device into the space beneath its base and, during the down-stroke, sends the then compressed gas via another flap valve or a similar device and a connecting passage to the inlet control ports of said internal combustion, reciprocating piston engine. The pump space of the piston pump which is formed by piston, cylinder liner and annular slide comprises an inlet passage and an outlet passage, equipped with diaphragm valves, respectively. The crankcase, having a cross-section of mainly circular form, is equipped with a rotatable annular slide, which is carried on bearings and into which, with a small amount of clearance, the connecting rod extends, the latter having uniform dimensions in the direction of the axis of the crankshaft at least in the area enclosed by said annular slide, to form a suction chamber A and a pressure chamber B of a separated connecting-rod pump within said annular slide. A large waste space formed by the crankcase can thus be avoided.

4 Claims, 3 Drawing Sheets

II 26
2
27, 31
25
27
29
4
25
32
28
K
27
21
10
22
24
23
14
12''
15
17
16
31
30
3'
5
B
A
1
8
P
9
12
13
11
II

INTERNAL COMBUSTION, RECIPROCATING PISTON ENGINE

BACKGROUND OF THE INVENTION

The present invention relates to a reciprocating-piston internal combustion engine with a piston which, in travelling to its upper dead center, sucks fresh gas via a controlled opening into the space beneath its base and, during the return stroke, compresses the gas and, via a connecting passage and another controlled opening, sends it to the cylinder of the internal combustion engine; and in the crankcase, the cross-section of the latter being of mainly circular form, with a connecting rod, which has unchanging dimensions in the direction of the axis of the crankshaft, including the ones of the crank eye, and which along its parallel front and back surfaces fits closely the mating even faces in the crankcase and thereby forms two separate spaces there, which by means of control devices form a connecting-rod pump.

DESCRIPTION OF THE PRIOR ART

A two-stroke internal combustion engine of this type is described in German Laid Open No. 710,288, with a crankcase which during the suction action in the crankcase pump is connected to its full extent with the inlet openings, whereas during compression of the charge the connecting rod, which beside causing reciprocation of the piston also accounts for transport of the medium, divides the crankcase into two separate spaces. Of these only the one being ahead of the connecting rod, in the direction corresponding to its motion, is used for compressing the charge, with separation being achieved by making the lateral faces and the crank end of the connecting rod fit closely the even and circular inner walls of the crank cheek. To seal the piston end of the connecting rod, a lateral projection has been attached to it, the lateral rim and exterior end of which move closely, and along the contour corresponding to the motion of said projection, by the inner walls of a recess located at the area where the cylinder joins the crankcase.

With this type of a crankcase pump for two-stroke engines their basically low engine efficiency has been improved to only a slight degree, due to the large waste spaces of the pump, and at relatively high expense on the construction side. The fact that the interior of the crankcase serves as suction, or pressure, chamber to both the connecting-rod pump as well as the piston pump and thereby connects them to each other excludes any field of application other than that of two-stroke engines.

There is shown, in U.S. Pat. No. 3,973,532, a four-stroke reciprocating piston internal combustion engine with a piston which, in travelling to its upper dead center, sucks air or a fuel-air mixture into the crankcase and, during the return stroke, sends air which has been compressed in the crankcase to the intake ports of said internal combustion engine. This design has the particular disadvantage of low stroke efficiency of the engine piston with respect to pressure rise obtained outside the cylinder, due to the large waste space the crankcase forms. To maximize the amount of transported air, e.g., with Diesel (or compression ignition) engines, the arrangement of the German Laid Open No. 36 37 811 provides for an auxiliary piston which is driven by the crankshaft and reciprocating in the opposite direction of the engine piston. This additional piston causes high friction losses, on the one hand, and, in general, has proved of poor mechanical efficiency. Also, this arrangement inevitably increases spatial dimensions and results in a considerable rise in expense.

SUMMARY OF THE INVENTION

It is an object of the present invention to avoid above described disadvantages and at the same time develop a crankcase pump of high versatility.

The present invention is characterized in that the crankcase is equipped with a rotatable annular slide, which is carried on bearings and into which the connecting rod extends with a small amount of clearance, to the effect that the piston, the cylinder liner and the annular slide form the pump space of a piston pump with one inlet passage and one outlet passage, both of them controlled by valves; and that the connecting rod seals across gaps with the crank cheek, on the one side, and the cover of the crankcase, on the other, to the effect that within the annular slide one suction chamber and one pressure chamber of a separated connecting-rod pump are formed, each of which connects via recesses, each embedded in said cover of the crankcase and located at about mirror-symmetric distance to the connecting rod when in bottom dead center position, with the respective valve-controlled inlet, or outlet, passage.

Accordingly, there is a small amount of waste space in the piston pump, and pressure within this pump rises at correspondingly higher rates. In further consequence, the space enclosed by the annular slide is divided by the connecting rod into two volumes, extensions of which change in continuing cycles and, thus, provide for suction and compression of a medium. By using the connecting rod as a means of displacement, high pressure increase rates can be achieved due to the fact that the medium is sucked in and forced out completely and without filling any waste spaces worth mentioning. The amount of transported medium can be varied by modifying the breadth of the connecting rod at constant length of stroke so that adaptability to differing technical requirements can be achieved. The reduction of waste space obtained through this type of arrangement results in a considerably higher stroke efficiency of the engine piston with respect to pressure rise obtained outside the cylinder. The volume of air transported in such a way serves as scavenge air in two-stroke engines or is used for supercharging four-stroke engines.

Therefore the present invention provides a possibility for charging two and/or four-stroke Diesel (or compression ignition) and/or Otto (or spark ignition) engines as well as internal combustion engines using other fuels than the aforementioned one such as, e.g., gas without any of them requiring an outside means, i.e., a blower, for scavenging or supercharging purposes. In spite of the high gain in air transported through the strokes of the engine piston, spatial dimensions remain practically unchanged if compared to internal combustion engines using conventional crankcase scavenging.

With an apparatus embodying the present invention simplicity of design is obtained by providing for constant width of the opening through which the connecting rod extends into the annular slide and by dimensioning the breadths of the connecting rod, along its length, such that, given any angular position the connecting rod arrives at the distance between said connecting rod and the edges of said opening, i.e., the clearance, remains about constant.

In the present invention the possibility is envisaged that the connecting-rod pump sucks in and compresses air and delivers the charge, together with the piston pump, into a manifold, located at the intake side of the cylinder. In special cases it can prove an advantage to use the connecting-rod pump as a separated pump providing for the transport of extraneous gases whereas the piston pump serves the charging of the engine.

DESCRIPTION OF THE DRAWINGS

The invention will now be illustrated by way of accompanying drawings in which.

DESCRIPTION OF THE PREFERRED EMBODIMENTS

Figure 1:
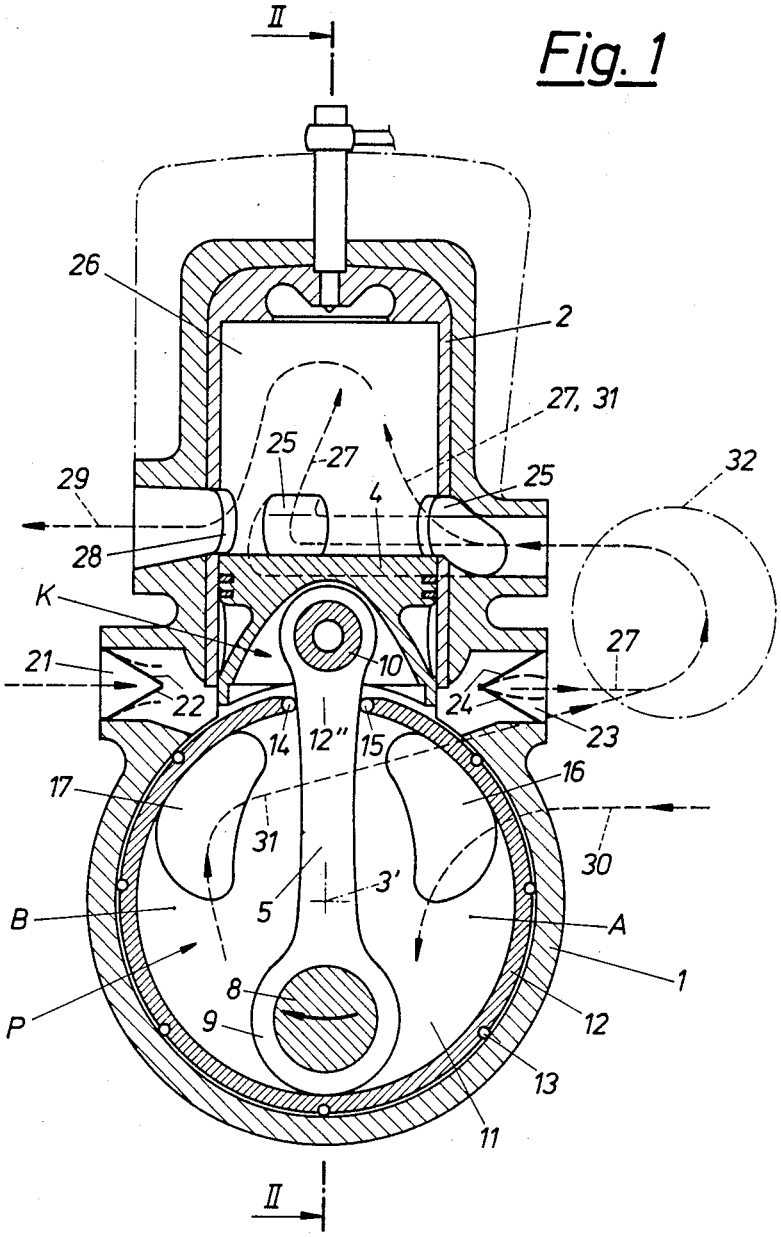
FIG. 1 is a sectional view along line I—I in FIG. 2 of the internal combustion engine embodying the present invention.

The two-stroke internal combustion engine consists of a crankcase 1, which is cast integral with a cylinder liner 2, and of a crankshaft 3, a piston 4, and a connecting rod 5. The crankshaft 3 is carried inside the crankcase 1 on rolling bearings 6 and projects into a stepped crank sheet 7, circumference of which fits closely the inner walls of the crankcase 1, with a crank pin 8 being attached to said crank cheek. This crank pin 8 is embedded in a crank eye 9 of the connecting rod 5, with the crank pin 8 equalling in length the unchanging dimensions of the connecting rod 5, in the direction of the axis 3' of the crankshaft 3. The connecting rod 5, which is connected to and driven by the piston 4 through a piston pin 10, has two parallel front and back surfaces 5' and 5", of which the back surface 5' fits closely the crank cheek 7 whereas the front surface 5" seals with a cover 11 of the crankcase 1.

In the lower part of the crankcase 1 there is a rotatable annular slide 12 carried on needle bearings. Instead of having needle bearings ensure circular motion of said slide, grooves can be machined into one of the sliding faces, in the direction of the crankshaft. Another variant would be to replace the annular slide by a parallel slide gate valve.

The connecting rod 5 extends, with a small amount of clearance, through an opening 12" determined by rounded edges 14 and 15 of the annular slide 12 into the interior of the latter, which is centered by means of a projection 12' and extends towards a recess 7' in the crank cheek 7. To keep the above mentioned clearance constant irrespective of the positions the connecting rod arrives at, the contour of the connecting rod 5 has been made to fit the opening, as illustrated in great detail in FIGS. 3 through 6.

Figure 2:
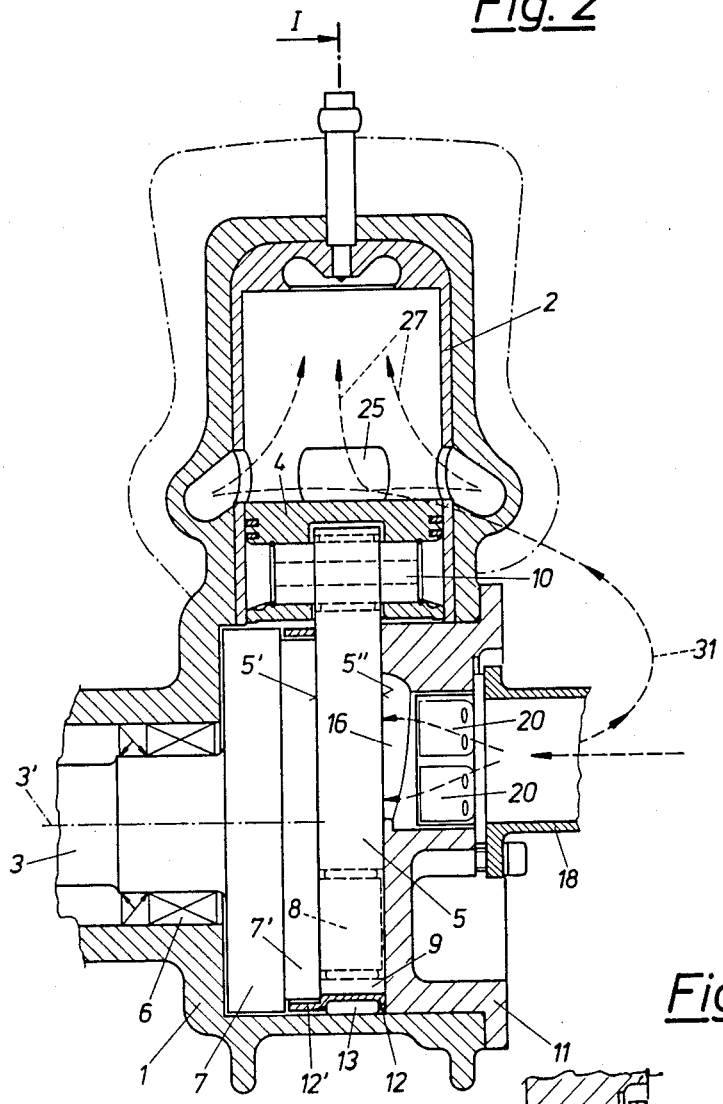
FIG. 2 is a sectional view along line II—II of FIG. 1.
Figure 2A:
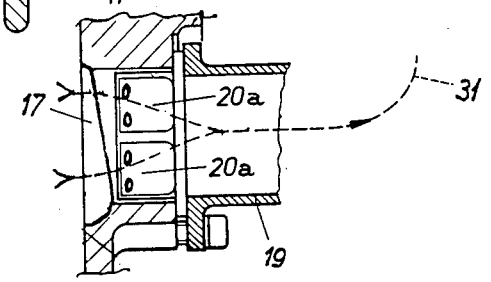
FIG. 2*a* shows the outlet passage similar to inlet passage of FIG. 2, and FIGS. 3 through 6 are diagrammatic views of the same apparatus illustrating operation thereof.
Figure 3:
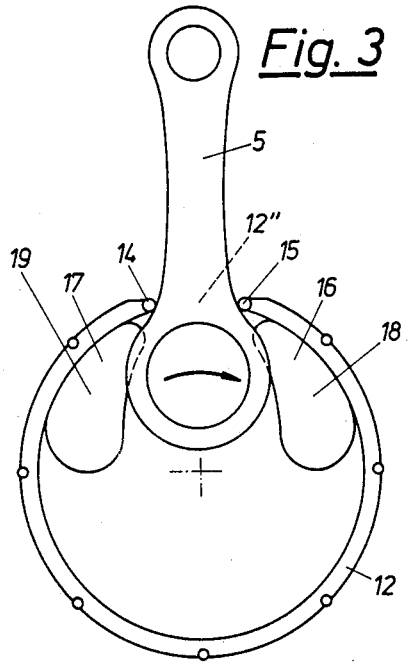
Figure 4:
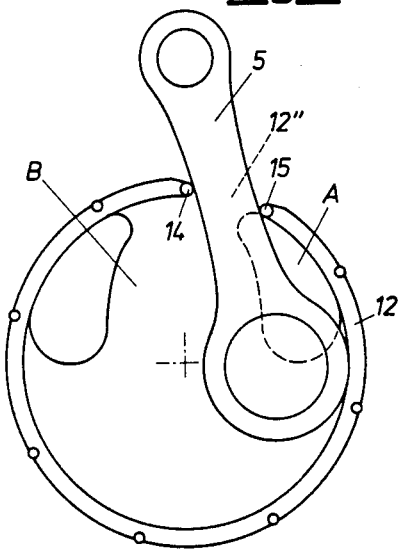

The connecting rod 5 divides the space enclosed by the annular slide 12 into a suction chamber A and a pressure chamber B, each of which connects via kidney-shaped recesses 16 and 17, respectively, located in the covert 11 of the crankcase 1, to inlet and outlet passages 18 and 19, respectively (see also FIG. 2*a*). The inlet passage 18 is controlled by diaphragms 20, the outlet passage 19 by diaphragms 20*a*, which prevent the gas from flowing back. Corresponding diaphragms are provided to the outlet passage 19, which is not further described here.

Figure 5:
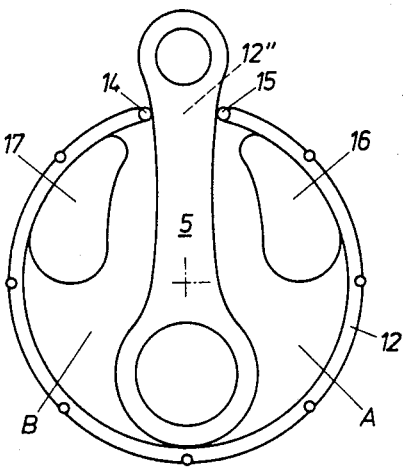
Figure 6:
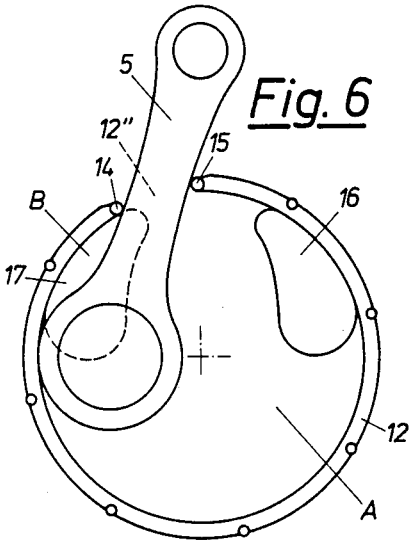

FIGS. 3 through 6 illustrate operational characteristics of the connecting-rod pump. Starting from the neutral position in FIG. 3, when the connecting rod has aproached the upper dead center, FIG. 4 then displays how the transported medium is being sucked into chamber A and removed from chamber B. FIG. 5 shows the moment when piston 4 and connecting rod 5 have reached their bottom dead center positions and the suction chamber A as well as the pressure chamber B have become equal in size. In FIG. 6 the conveyed medium has been almost completely forced out, while the size of the suction chamber A has reached almost maximum. In any of the positions which the connecting rod 5 arrives at the distance between the connecting rod and edges 14 and 15 of the annular slide 12, i.e., the clearance, remains constant and of the desired small value, as a result of the well-fitting contour of the connecting rod.

As the annular slide 12 separates the working space of the piston pump from the crankcase, there is but a small amount of waste space, as FIG. 1 clearly shows. This piston pump sucks in air via an inlet passage 21, controlled by diaphragms 22, and sends compressed air through an outlet passage 23, controlled by diaphragms 24. Said compressed air is admitted to a cylinder chamber 26 through inlet ports 25 in the cylinder liner 2, as illustrated in the drawing by a broken line 27. At the same time the exhaust gas is discharged through an outlet port 28, as indicated by a broken line 29. The flow of air sucked into the connecting-rod pump is indicated by a broken line 30, that of air forced out from there by a broken line 31. Given the case of a multicylinder type of engine, the possibility is envisaged of providing a manifold 32, into which both the connecting-rod pump and the piston pump deliver their charges.

In practice, internal combustion engines embodying the present invention can be installed in Otto (or spark ignition) as well as Diesel (or compression ignition) engines and in gas-driven engines, operating through two and four-stroke cycles alike, and they are particularly suited where small-size engines drive, for instance, chainsaws, portable power units and pumps as well as mopeds or motorcycles or airplanes such as gliders. Nevertheless, practical application of an apparatus embodying the present invention also includes medium and large sized engines of both the one-cylinder and multicylinder types, if crankcases have been made to fit the new spatial requirements.

We claim:

1. A reciprocating-piston internal combustion engine, comprising at least one cylinder which has controlled openings and a cylinder liner; a piston mounted within said cylinder, said piston defining an upper dead center and a bottom dead center, on its up-stroke said piston sucks fresh gas via one of said controlled openings into a space beneath said piston and, on its down-stroke sends compressed gas via a connecting passage and another of said controlled openings to said cylinder; said internal combustion engine further comprising a crankshaft defining an axis; a connecting rod with a crank eye, interconnecting said piston and said crankshaft; a crankcase having a cross-section of mainly circular form, said connecting rod and said crank eye having uniform dimensions in the direction of said axis of said crankshaft, said connecting rod having a parallel front and back surface fitting closely to mating surfaces in said crankcase, thereby forming a connecting-rod pump, wherein said crankcase comprises a rotatable annular slide, which is carried on bearings having an opening through which said connecting rod extends with a small amount of clearance, wherein said piston, said cylinder liner and said annular slide forming a pump space of a piston pump with one inlet passage and one outlet passage, both of said inlet and outlet passages are controlled by valves; and wherein said annular slide, said connecting rod, a crank cheek of said crankshaft on the one side, and a cover of said crankcase on the other, forming a suction chamber and a pressure chamber of said connecting-rod pump, which is separated from said piston pump, wherein said suction chamber and said pressure chamber are connected via respective recesses—each situated in said cover of said crankcase and located at mirror-symmetric distance to said connecting rod in its bottom dead center position—with respective valve-controlled inlet and outlet passages.

2. A reciprocating-piston internal combustion engine according to claim 1, wherein the width of said opening through which said connecting rod extends into said annular slide remains constant and the breadths of said connecting rod, along its length, are such dimensioned that, at any given angular position of said connecting rod, the distance between said connecting rod and edges of said opening, remains about constant.

3. A reciprocating-piston internal combustion engine according to claim 1, wherein said connecting rod pump sucks in and compresses air and delivers the charge, together with said piston pump into a manifold, located at the intake side of said cylinder of said internal combustion engine.

4. A reciprocating-piston internal combustion engine according to claim 1, wherein said connecting-rod pump is used as a separated pump providing for pumping extraneous gases whereas said piston pump serves for charging said internal combustion engine.

* * * * *

UNITED STATES PATENT AND TRADEMARK OFFICE

CERTIFICATE OF CORRECTION

PATENT NO. : 4,813,387

DATED : March 21, 1989

INVENTOR(S) : Kurt Prevedel, Peter Wunsche, Hans Oberth

It is certified that error appears in the above-identified patent and that said Letters Patent is hereby corrected as shown below:

In the title page, correct the name of the Assignee to read --AVL Gesellschaft fur Verbrennungskraftmaschinen und Messtechnik mbH. Prof. Dr. Dr. h.c. Hans List--.

Signed and Sealed this

Twenty-eighth Day of August, 1990

*Attest:*

HARRY F. MANBECK, JR.

*Attesting Officer*

*Commissioner of Patents and Trademarks*